United States Patent [19]

Kucera et al.

[11] 4,306,802

[45] Dec. 22, 1981

[54] CASSETTE AND HEATING ARRANGEMENT FOR PHOTOCOPY MACHINE

[75] Inventors: Thomas J. Kucera, Evanston; Stanley J. Szczesniak, Lindenhurst; Patrick P. McPhail, Round Lake, all of Ill.

[73] Assignee: Apeco Corporation, Des Plaines, Ill.

[21] Appl. No.: 187,513

[22] Filed: Sep. 15, 1980

[51] Int. Cl.[3] ..... G03G 15/00

[52] U.S. Cl. ..... 355/3 R; 219/216

[58] Field of Search ..... 219/216, 388, 471; 355/3 R, 30, 10; 165/26; 271/10, 107; 432/230

[56] References Cited

U.S. PATENT DOCUMENTS

| | | | |
|---|---|---|---|
| 3,519,253 | 5/1970 | Aser et al. | 219/216 X |
| 3,615,130 | 10/1971 | Suzuki et al. | 355/3 R X |
| 3,677,632 | 7/1972 | MacDonald | 355/3 R |
| 3,957,369 | 5/1976 | Wirth | 219/216 X |

*Primary Examiner*—Volodymyr Y. Mayewsky

*Attorney, Agent, or Firm*—Leydig, Voit, Osann, Mayer & Holt, Ltd.

[57] ABSTRACT

A cassette and heating arrangement for a photocopy machine having a transport system including an in-feed roller with conventional components for acting upon a sheet to produce a developed image during transport of the sheet from an entry way to a discharge slot. A copy sheet cassette is provided including a shallow rectangular tray for a stack of copy sheets having a cover hinged at the rear end of the tray to extend over the top of the tray but foreshortened to leave the front portion of the tray uncovered. The housing of the machine has a receptacle at the entry way for plugging in the cassette with the front portion of the cassette being totally accommodated within the housing and with the front portion of the stack of sheets carried by the cassette in engagement with the in-feed roller. A first heating element is mounted in the cover of the cassette for heating the body portion of the stack while a second heating element is mounted in the housing above the front end of the cassette for heating the front portion of the stack to keep the leading edges of the sheets dry and therefore free of waviness as the sheets are transported through the machine.

15 Claims, 9 Drawing Figures

Fig. 1.
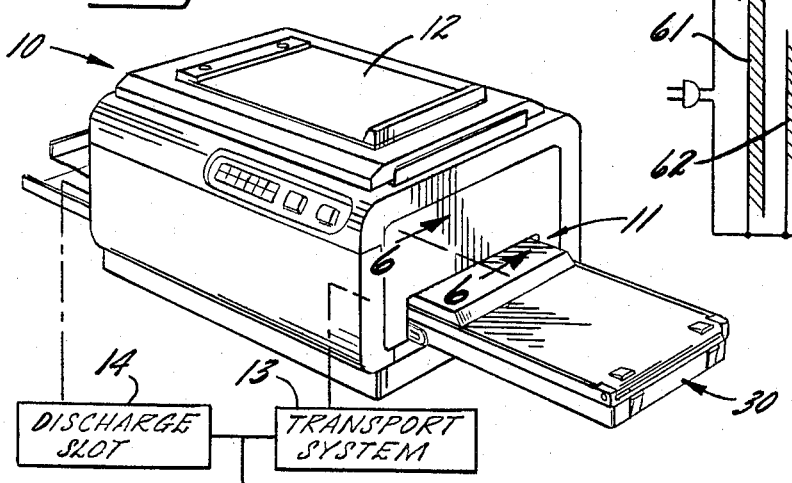
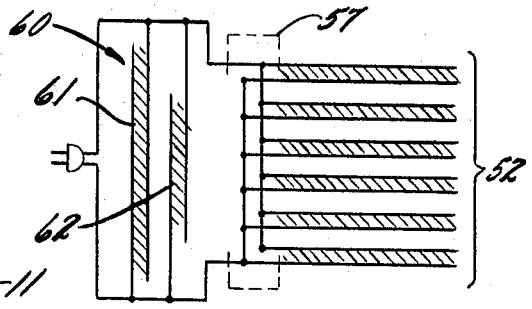
Fig. 9.
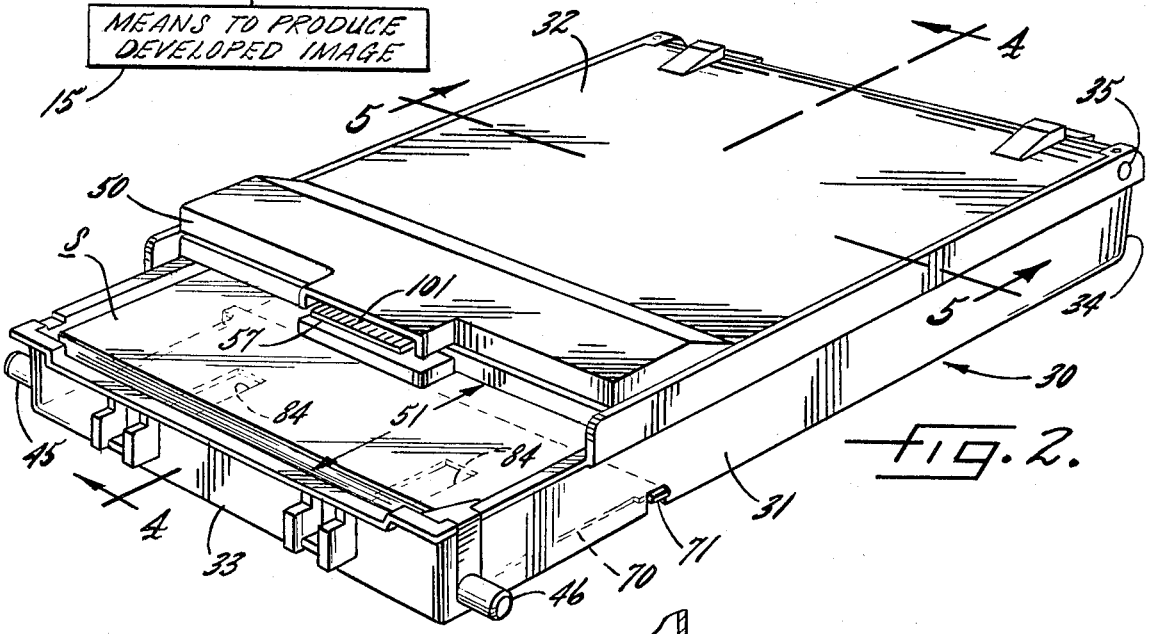
Fig. 2.
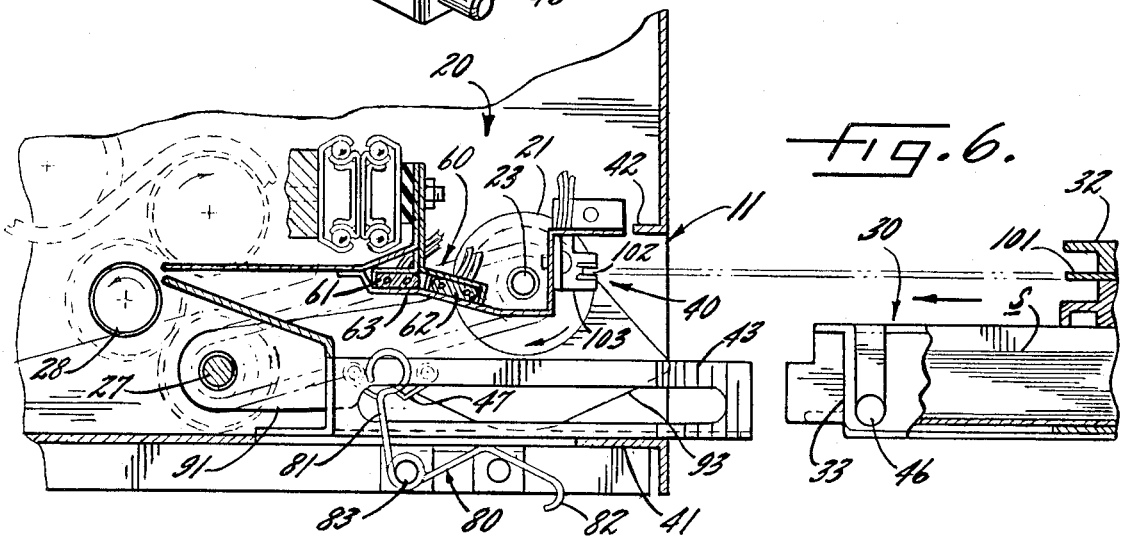
Fig. 6.

53
50
57
32
101
54
52
52
52
56
56
56
55
35
71
34
105
73
31
71
70
84
72
45
84
33
30
73
46

CASSETTE AND HEATING ARRANGEMENT FOR PHOTOCOPY MACHINE

Copy sheets of the type employed in electrostatic photocopy machines tend to accumulate moisture in storage or when stacked in a machine in a humid ambient during periods of non-use. Moisture in a sheet is undesirable for a number of reasons. Not only does it tend to dissipate the electrostatic charges upon which a clear and crisp image depends but it also results in deformation of the sheet due to uneven moisture absorption and uneven drying as the sheet proceeds through the machine, causing the sheet to track poorly in the transport path.

It is known to provide a small wattage heating element in the chamber which contains the stack of paper in an effort to dry it or to keep it dry. However, it has been found that where the chamber is in the form of a cassette attached to the photocopy machine the leading edges of the sheets tend to develop a waviness which prevents proper passage of the sheet through the nips of respective transport rollers, raising risk of a jam.

It is, accordingly, an object of the present invention to provide a cassette and heating arrangement for a photocopy machine in which a stack of sheets is heated to maintain a uniformly dry condition so that the leading edge of the sheet is free of any tendency toward waviness which might cause the sheet to track poorly or to create a jamming condition along the path of transport as well as to enhance the quality of the copy.

It is another object to provide a cassette and sheet heating arrangement which prevents absorption of moisture by a stack of sheets which has been stored in dry condition and which removes moisture from sheets which have become moist in storage. In this connection it is an object to provide a heating arrangement for a stack of photocopy sheets in which the heat is applied more or less uniformly over the sheet area but is concentrated upon the leading edges of the sheets, particularly the sheets which are topmost and therefore first to be used.

It is a general object to provide a heating arrangement for a stack of sheets contained in a cassette in which a heater in the cover of the casette radiantly heats the body of the sheet while a separate heater is provided in the housing into which the cassette is inserted for heating the front end of the stack thereby insuring flatness of the leading edges of the sheets for trouble-free feeding and transport. It is a related object to provide a heating arrangement including a heater in the housing of the photocopy machine which is integrated in a novel manner with the in-feed roller and related parts so that heat is applied to the leading edge of each sheet in the stack regardless of the size of the stack, successively down to the last sheet.

It is, moreover, an object of the present invention to provide a cassette and heating arrangement for a stack of sheets which works with equal effectiveness both for the uncoated sheets employed in a "plain paper" copier and sheets which are especially coated with dielectric or light sensitive material.

It is still another object to provide a cassette and heating arrangement which assures uniformity of the copies and reliability of sheet transport, not only preserving the desirable characteristics of sheets which are dry upon loading but in correcting the abnormality caused by sheets which have been improperly stored in a region of high humidity. In this connection it is a general object to provide a cassette and heating arrangement which produces optimum results regardless of whether the photocopier is employed in an arid region or in a moisture saturated environment.

It is an object of the invention in one of its aspects to provide a heating arrangement capable of keeping a stack of sheets above the temperature of the ambient atmosphere utilizing a heating element in the form of a conductive polymer having a resistance which varies with temperature whereby an equilibrium temperature may be maintained on a constantly energized basis without use of thermostats or other control devices.

The above is accomplished economically and by means normally requiring no maintenance over the life of the photocopier. The heating arrangement is highly compact enabling it to be used not only in new machines but, by retrofit, in designs of machines already in the field.

Other objects and advantages of the invention will become apparent upon reading the attached detailed description and upon reference to the drawings in which:

FIG. 1 shows, in perspective, a typical design of photocopy machine to which the invention has been applied.

FIG. 2 is a perspective view of the cassette employed in the machine of FIG. 1.

FIG. 6 is a fragmentary section, in elevation, showing a cassette about to be plugged into a photocopy machine as viewed along line 6—6 in FIG. 1.

FIG. 9 is a schematic wiring diagram showing the heater connections.

Figure 3:
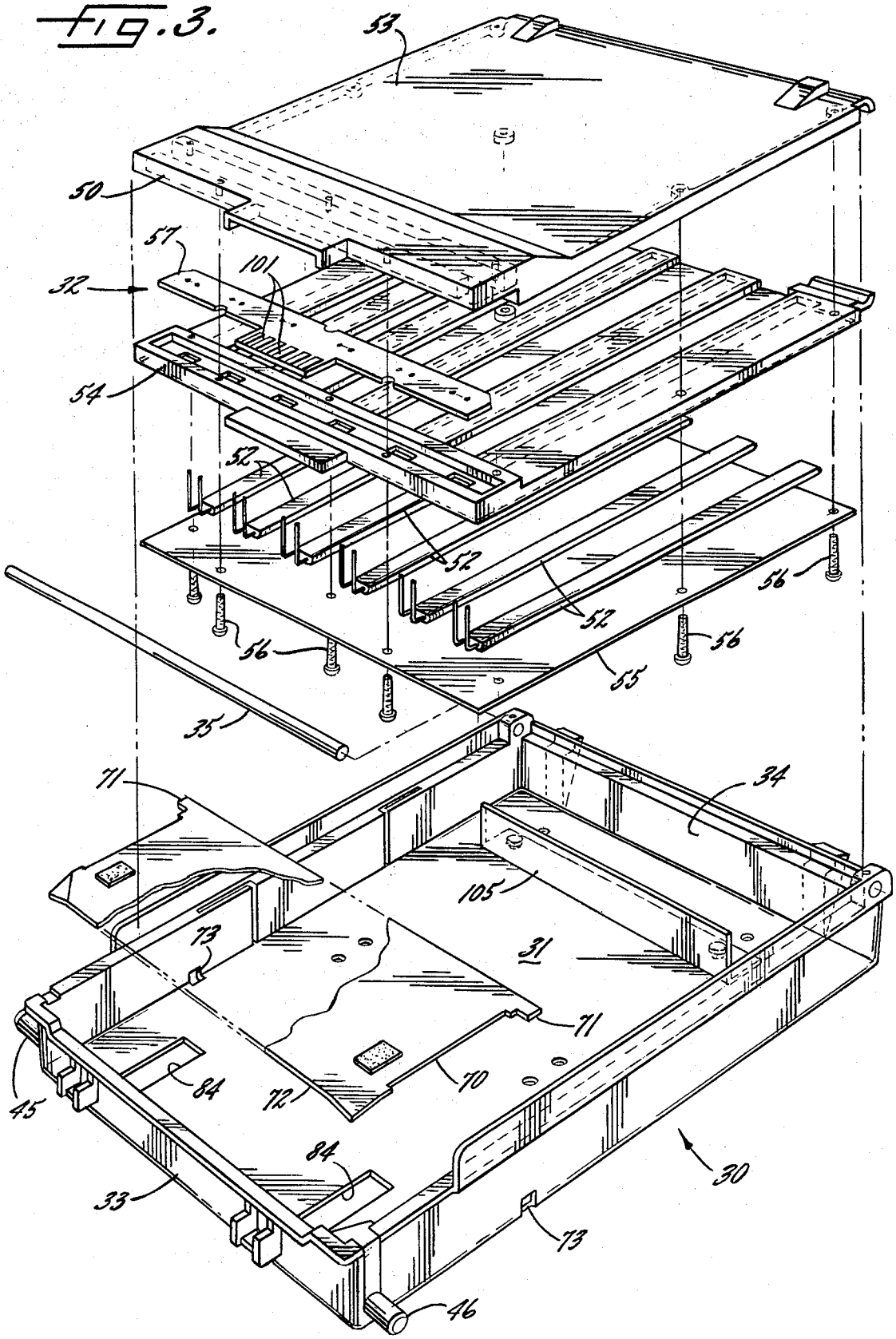
FIG. 3 is an exploded view of the cassette of FIG. 2.

While the invention has been shown and described in connection with a preferred embodiment, it will be understood that there is no intention to limit the invention to the embodiment disclosed and that we intend to cover the various alternative and equivalent constructions included within the spirit and scope of the appended claims.

Turning now to the drawings there is shown in FIG. 1 a typical photocopy machine to which the invention has been applied having a housing 10 with an entry way 11 for the copy sheets. At the top of the machine is a transparent platen upon which the original document is placed and against which it is held by a flexible cover 12.

The machine will be understood, for present purposes, to have a conventional transport system 13 for transporting a copy sheet between the entry way and a discharge slot 14, with means 15 acting upon the sheet en route for producing on the copy sheet the developed image of the original.

Figure 8:
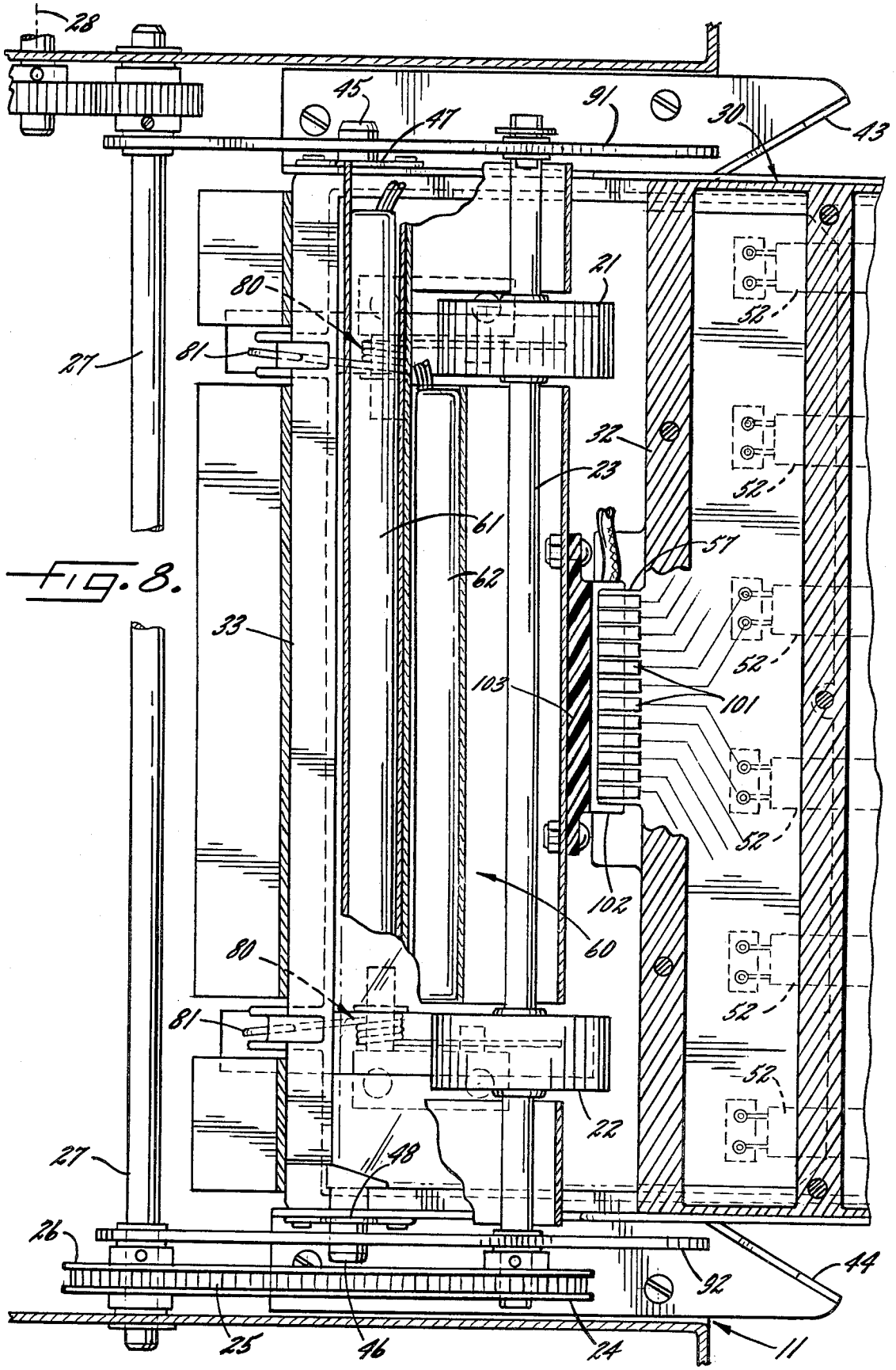
FIG. 8 is a horizontal fragmentary section taken along line 8—8 in FIG. 7.

For the purpose of feeding sheets seriatim through the entry way a feeding assembly 20 is provided (see FIGS. 6 and 8) including a pair of resiliently surfaced in-feed rollers 21, 22 mounted upon a driven shaft 23 which carries at its end a pulley 24. The pulley is engaged by a belt 25 which is trained about a drive pulley 26 on a drive shaft 27, the latter being coupled to a driving source by means of a clutch 28. While no means has been illustrated for controlling the clutch, it will be understood, as is common in photocopy machines, that circuitry is provided for energizing the clutch intermittently as the control system of the machine calls for feeding of a sheet.

In carrying out the present invention a cassette 30 is provided holding a stack of copy sheets S and from which the copy sheets are fed into the entry way 11 of the machine. The cassette is in the form of a shallow rectangular tray 31 having a superimposed fitted cover 32. The tray has a front end 33 and a rear end 34, with a hinge 35 being located at the rear end for securing the members together.

The cassette is designed so that its front end may be plugged horizontally into the housing. For this purpose the housing is provided with a receptacle 40 defined by a shelf 41 and an upper edge 42 adjacent the in-feed rollers 21, 22.

For guiding the cassette into the receptacle guides 43, 44 are provided along the lateral edges of the receptacle horizontally slotted for reception of pilot pins 45, 46, respectively which project laterally at the front end 33 of the tray. At the inner ends of the guides detent springs 47, 48 define a fully inserted, or bottomed, position for the cassette. With the pilot pins 45, 46 fully seated, the overhanging weight of the cassette is borne by the shelf surface 41.

In carrying out the invention the cover 32 of the cassette has a front edge 50 which is foreshortened so as to leave the front portion 51 of the cassette uncovered. The "open" area at the front of the cassette is totally accommodated within the housing so that the front portion of the stack of sheets S carried by the cassette lies below the in-feed rollers 21, 22 for feeding of sheets seriatim from the top of the stack beginning with the top sheet S1.

In accordance with the present invention a first heating element is mounted in the cover of the cassette for heating the body portion of the stack and a second heating element is mounted in the housing to extend above the front end of the cassette and parallel thereto for heating the front portion of the stack to keep the leading edges of the sheets dry and therefore free of waviness as the sheets are transported through the machine. The first heating element is made up of a series of individual elements 52. As shown in the exploded view, FIG. 3, the cover is of "sandwich" construction including an insulative top plate 53, an extensive central plate 54 which includes the heating elements, and a thermally conductive bottom plate 55. The plates 53–55 are secured intimately together by means of screws 56 so that the heating elements 52 are in direct thermal engagement with the conductive bottom plate which may, for example, be of aluminum and which radiates heat uniformly over the body portion of the stack of sheets. Included within the "sandwich" is a terminal strip 57 which serves as a header for making of electrical connections to the individual heating elements.

For the purpose of heating the leading edges of the sheets at the front portion of the stack, a second heating element 60 is provided in the housing consisting of individual elements 61, 62 which extend transversely above the front end of the cassette and parallel thereto. The individual heating elements 61, 62 are supported upon a thermally conductive plate 63. The element 61 extends substantially the width of the sheet while the element 62 is somewhat shorter, occupying the space between the two infeed rollers 21, 22 (see FIG. 8) thereby to accommodate the vertical motion of the in-feed rollers.

Figure 4:
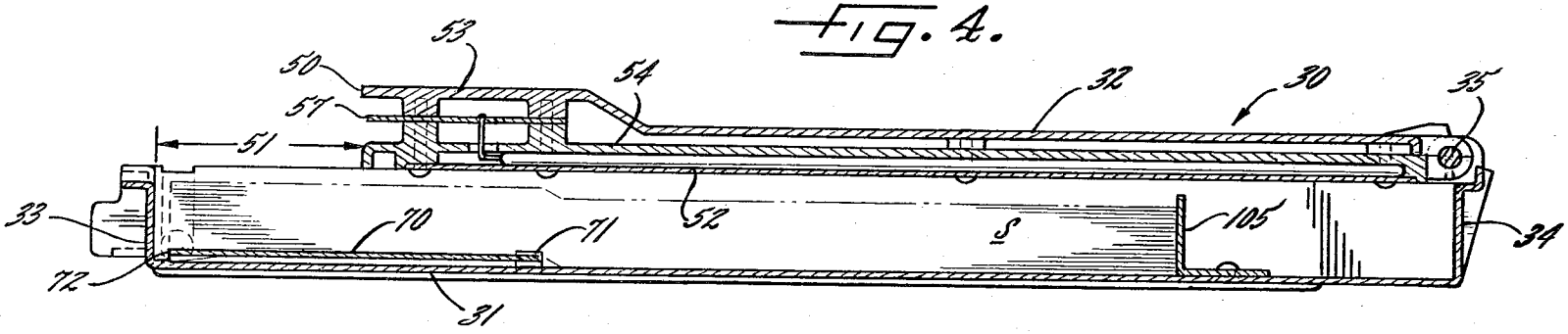
FIG. 4 is a longitudinal section taken along line 4—4 in FIG. 2.
Figure 7:
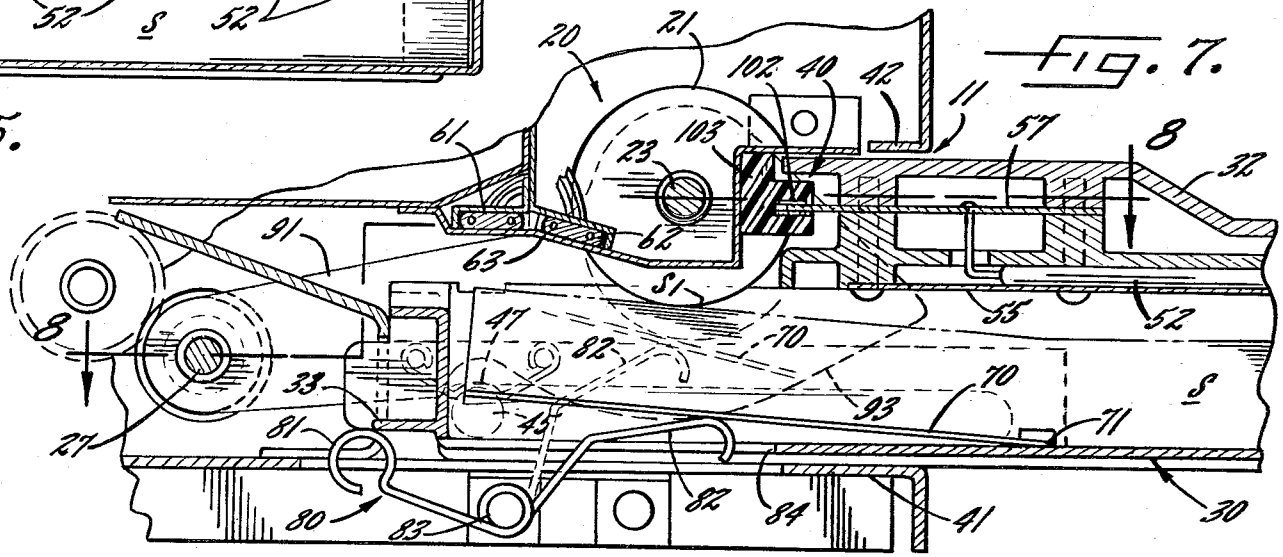
FIG. 7 is a view similar to FIG. 6 but showing the cassette in its bottomed operating position within the machine.

In accordance with one of the features of the present invention means are provided for elevating the front portion of the stack of sheets into close proximity to the heating element, as well as into engagement with the in-feed rollers, automatically as the cassette is plugged into its bottomed position. Referring to FIGS. 3, 4 and 7, the front portion of the stack is elevated by means of a ramp plate 70 having a pivoted edge 71 and a forwardly facing edge 72. The pivoted edge 71 has ears or extensions which are fitted into registering openings 73 formed in the side walls of the tray (FIG. 3) adjacent the bottom thereof. When the cassette is out of the machine the ramp plate 70 occupies an inactive position lying flatly at the bottom of the tray.

For the purpose of raising the ramp plate 70 and hence the front portion of the stack as the cassette is inserted, a pair of bell crank levers 80 (see FIG. 6) are provided in the bottom of the housing having a first arm 81 arranged in the path of movement of the tray 31 and a second arm 82 which swings vertically upwardly to engage the ramp plate when the first arm is actuated, the levers being centrally pivoted to the housing upon a pivot pin 83. For providing clearance so that the arms 82 of the bell cranks may press directly upon the ramp plate, registering openings 84 are provided in the bottom of the tray.

The effect, upon the stack of sheets, of inserting the cassette into its bottomed position in the housing of the machine may be seen by comparing FIGS. 6 and 7. Prior to insertion the bell cranks 80 are in the position illustrated in FIG. 6 with the first arm 81 of each bell crank occupying a vertical position tending to obstruct entry of the cassette. However, as the cassette is plugged in, the front end 33 of the tray engages the first arms 81 of the bell cranks causing them to rotate simultaneously in the counterclockwise direction as viewed in FIG. 7 so that the arms 82 rock upwardly against the underside of the ramp plate 70 raising the ramp plate and, with it, the front end of the stack into proximity with the heating element 60 in the housing. Thus the front portion of the stack, and specifically the leading edges of the sheets forming the stack, are brought into close thermal relation to the heat conductive, radiant plate 63 which is in contact with the individual heating elements 61, 62.

Figure 5:
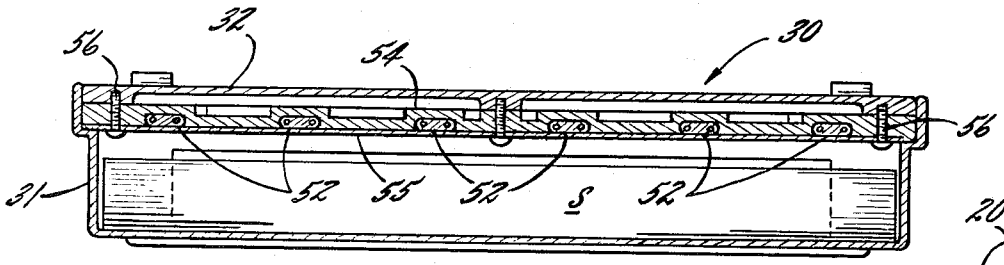
FIG. 5 is a transverse section taken along line 5—5 in FIG. 2.

It is a further feature of the construction that the bell crank levers 80 include a spring, here obtained by forming the levers of spring wire so that the force upwardly applied against the ramp plate is resilient in nature tending to constantly urge the top of the stack into the proximity of the heating element 60 as the stack is depleted. Referring more specifically to FIG. 5, the position of the ramp plate 70 and the position of the lever arm 82 which engages it is shown in full lines corresponding to the condition where the stack has full weight and thickness. This insures that the top sheet S1 is close to the heating element. As the stack is depleted by the feeding of the sheets its weight becomes less so that, by reason of the spring action, the arm 82 is permitted to expand upwardly, continuing to extend itself as the stack becomes lighter until, as the lowermost sheet is being fed, the arm 82 and ramp plate 70 occupy the positions shown by the dotted lines. In short, each sheet from the first to the last is enabled to clear the front of the tray for passage into the transport system and each sheet from the first to the last is supported in substantially equal proximity to the heating element 60. For the purpose of floatingly mounting the in-feed rollers 21, 22 for vertical movement, the shaft 23 thereof is mounted upon a pair of horizontal arms 91, 92 which are pivoted for swinging movement about the drive shaft 27. The lower edges of the arms are formed with curved cam surfaces 93 which, as shown in FIG. 6, lie in the path of entry movement of the respective pilot pins 45, 46 so that the rollers 21, 22 are cammed upwardly to clear the front edge 33 of the cassette tray and then released for downward movement with gravity bias as the cassette is plugged into position.

In accordance with one of the features of the present construction the foreshortened cover 32 of the cassette has, along its front edge, a series of electrical terminals which are connected to the individual heating elements 52 in the cassette and which cooperate with electrical terminals within the receptacle which are connected to a source of power for making contact automatically when the cassette is plugged into position. The terminals on the cover of the cassette, indicated at 101, are mounted on the leading edge of the terminal strip 57 (FIG. 3) while the terminals in the receptacle, indicated at 102 are mounted in a registering terminal block 103 mounted upon the heater plate 63 (FIG. 6). The heating elements may be wired in any desired configuration, either parallel or series, to achieve the desired low level of wattage and a proper wattage ratio between the heater and the cassette and that in the housing of the machine. It is preferred that the wattage of the heater in the machine, and which acts upon the leading edges of the sheets, shall be about 29 percent of the total wattage; for example, the heater in the cassette may have a wattage of 20 while the heater in the housing may have a wattage of 8. Since the heaters are permanently connected to the power line it is desired to keep the wattage low so that it is a negligible cost factor, and it will be understood that the suggested wattages are not sufficient to bring about prompt drying of a stack of sheets which has been stored for some time unprotected in a humid environment. Such level of heat is, however, adequate to maintain a reasonably dry stack in optimum condition regardless of ambient humidity. Because of the application of heat at the leading edge of the stack which characterizes the present invention, waviness at the leading edge, encountered in use of conventional cassettes, is avoided, along with the risk of the paper jam, even though the body of the sheet may still have a high residual moisture content.

It is one of the features of the present invention that the heating elements 52 in the cassette and 61, 62 in the housing are formed of an electrically conductive polymer having a resistance which varies directly with temperature so that the element is self-regulating to a predetermined temperature without use of control elements such as a thermostat. Such heating elements are commercially available and sold under the trade name "CHEMLEX" manufactured by Ray Chem Corporation whose address is 300 Constitution Drive, Menlo Park, Calif. 94025 and the details of which are described by J. Meyer in an article in *Polymer Engineering and Science* of Nov. 1973, Vol. 13, No. 11, pp. 462 to 468 entitled "Glass Transition Temperature as a Guide to Selection of Polymers Suitable for PTC Materials". Such elements are highly desirable in the present usage since they provide a constant temperature preferably within the range of 150 degrees F. to 185 degrees F., while completely avoiding the maintenance problems associated with the use of special control circuitry or a thermostat of the make-and-break type.

One of the reasons that it is practical to employ low wattage in the present heating system is that the heat is efficiently utilized. The heat generated in the multi-unit heating element 52 in the cassette is transmitted, with minimum loss, to the conductive plate 55 which serves as an efficient radiator close coupled to the stack. Because of the long wave length of the radiation it is capable of penetrating into the stack as well as superficially upon the first sheet to be discharged. In addition to the radiant effect there is a normal convection of warmed air throughout the open spaces within the cassette with loss being minimized by the insulative cover 53 and the total enclosure. The heat from the multi-unit heat element 60 in the housing is also efficiently utilized being conducted directly to the radiant plate 63 which is in close proximity to the front portion of the stack by reason of the raising of the ramp plate 70 which supports the stack.

It is one of the features of the cassette that it is usable with both short and long copy paper simply by placing an end stop 105 adjacent the rear end of the stack, the end stop being so located as to insure that the leading end of the stack occupies a reference position with respect to the heating element 60 and in-feed roller 21.

While the heating arrangement has been found to be particularly advantageous with "plain" copy paper, correcting both front edge waviness and dissipation of electrostatic charge, the invention is not limited thereto and the same cassette and heating arrangement may be employed with advantage for special photocopy papers coated with a dielectric or light sensitive material.

The heating arrangement is not only effective but inherently economical and compact, with the heating element 60 in the housing occupying such a small volume as to make the heating system totally adaptable not only to new designs of photocopy machines employing cassettes but also existing designs. Indeed it is possible to apply the invention, by retrofitting, to machines already in the field, especially in areas where high ambient humidity has caused service problems and loss of copy quality.

What we claim is:

1. In a photocopy machine the combination comprising a housing having a copy sheet entry way and discharge slot, a copy sheet transport system including an intermittently driven in-feed roller, means acting upon a copy sheet to produce a developed image thereon during transport of the sheet from the entry way to the discharge slot, a copy sheet cassette including a shallow rectangular tray for a stack of copy sheets and having a front end and a rear end, the cassette including a fitted cover extending over the top of the tray but foreshortened to leave the front portion of the tray uncovered, the housing defining a receptacle at the entry way fitted to the front end of the cassette for plugging the cassette into the housing to a bottomed position in which the uncovered front portion of the cassette is totally accommodated within the housing and so that the front portion of the stack of sheets carried by the cassette lies below the in-feed roller for engagement thereby for feeding of sheets seriatim from the top of the stack, a first heating element mounted in the cover of the cassette for heating the body portion of the stack, a second heating element mounted in the housing to extend above the front end of the cassette and parallel thereto for heating the front portion of the stack to keep the leading edges of the sheet dry and therefore free of waviness as the sheets are transported through the machine, and means for supplying current to the heating elements.

2. In a photocopy machine the combination comprising a housing having a copy sheet entry way and discharge slot, a copy sheet transport system including an intermittently driven in-feed roller, means acting upon a copy sheet to produce a developed image thereon during transport of the sheet from the entry way to the discharge slot, a copy sheet cassette including a shallow rectangular tray for a stack of copy sheets and having a front end and a rear end, the cassette including a fitted cover extending over the top of the tray but foreshortened to leave the front portion of the tray uncovered, the housing defining a receptacle at the entry way fitted to the front end of the cassette for plugging the cassette into the housing to a bottomed position in which the uncovered front portion of the cassette is totally accommodated within the housing and so that the front portion of the stack of sheets carried by the cassette lies below the in-feed roller for engagement thereby for feeding of sheets seriatim from the top of the stack, a heating element mounted in the housing to extend above the front end of the cassette and parallel thereto for heating the front portion of the stack to keep the leading edges of the sheets dry and therefore free of waviness as the sheets are transported through the machine, means for supplying current to the heating element, and means actuated automatically as the cassette is plugged into bottomed position for elevating the front portion of the stack into close proximity to the heating element.

3. The combination as claimed in claim 2 in which the elevating means includes a spring element so that the stack continues to be elevated as the stack is depleted and becomes lighter thereby to insure that the top sheet of the stack is in substantially constant proximity to the heating element.

4. In a photocopy machine the combination comprising a housing having a copy sheet entry way and discharge slot, a copy sheet transport system including an intermittently driven in-feed roller, means acting upon a copy sheet to produce a developed image thereon during transport of the sheet from the entry way to the discharge slot, a copy sheet cassette including a shallow rectangular tray for a stack of copy sheets and having a front end and a rear end, the cassette including a fitted cover having a foreshortened front edge so that the front portion of the tray is left uncovered, the housing defining a receptacle at the entry way fitted to the front end of the cassette for plugging the cassette into the housing to a bottomed position in which the uncovered front portion of the cassette is totally accommodated within the housing and so that the front portion of the stack of sheets carried by the cassette lies below the in-feed roller for engagement thereby for feeding sheets seriatim from the top of the stack, a first heating element in the cover of the cassette for heating the body portion of the stack, electrical terminals on the front edge of the cover connected to the first heating element, cooperating electrical terminals within the receptacle in the housing for engagement with the terminals on the cover when the cassette is plugged in to furnish current to the first heating element, a second heating element in the housing extending transversely in a position above the front end of the cassette serving to heat the front portion of the stack to keep the leading edges of the sheets dry and free of waviness as the sheets are transported through the machine, and means for supplying current to the second heating element.

5. In a photocopy machine the combination comprising a housing having a copy sheet entry way and discharge slot, a copy sheet transport system including an intermittently driven in-feed roller, means acting upon a copy sheet to produce a developed image thereon during transport of a sheet from the entry way to the discharge slot, a copy sheet cassette including a shallow rectangular tray for a stack of copy sheets and having a front end and a rear end, the cassette including a fitted cover extending over the top of the tray but foreshortened to leave the front portion of the tray uncovered, the housing defining a receptacle at the entry way fitted to the front end of the cassette for plugging the cassette into the housing to a bottomed position in which the uncovered front portion of the cassette is totally accommodated within the housing and so that the front portion of the stack of sheets carried by the cassette lies below the in-feed roller, a ramp plate in the tray under the front portion of the stack, means actuated upon plugging the cassette into a bottomed position for raising the ramp plate so that the front portion of the stack is raised clear of the bottom of the tray and so that the top sheet of the stack lies above the front edge of the tray and is in frictional engagement with the underside of the in-feed roller for feeding of the top sheet into the transport system, means including a heating element arranged adjacent the front portion of the stack for heating the same so that the leading edges of the sheets fed through the transport system are dry and free of waviness, and means for supplying current to the heating element.

6. The combination as claimed in claim 5 in which the means for raising the ramp is in the form of a bell crank lever which is pivoted in the housing under the front end of the inserted cassette, the bell crank lever having a first arm which is engaged by the front end of the tray as the cassette is inserted and a second arm which swings upwardly through the bottom surface of the tray into engagement with the underside of the ramp plate for raising the same.

7. The combination as claimed in claim 6 in which the bell crank lever is formed of a bent piece of spring wire so that the force upwardly applied against the ramp plate is resilient in nature tending to constantly urge the top of the stack into the proximity of the heating element as the stack is depleted.

8. The combination as claimed in claim 5 in which the means for raising the ramp plate includes a spring automatically actuated upon plugging the tray into its bottomed position, the spring biasing the front edge of the stack upwardly so that the top sheet is in frictional engagement with the in-feed roller and clears the front edge of the tray for passage into the transport system with the spring continuing to extend itself as the stack is depleted and becomes lighter to insure that all of the sheets are raised into proximity to the heating element prior to feeding by the in-feed roller.

9. In a photocopy machine the combination comprising a housing having a copy sheet entry way and discharge slot, a copy sheet transport system including a pair of intermittently driven in-feed rollers, means acting upon a copy sheet to produce a developed image thereon during transport of the sheet from the entry way to the discharge slot, a copy sheet cassette including a shallow rectangular tray for a stack of copy sheets and having a front end and a rear end, the cassette including a fitted cover extending over the top of the tray but foreshortened to leave the front portion of the tray uncovered, the housing defining a receptacle at the entry way fitted to the front end of the cassette for plugging the cassette into the housing to a bottomed position in which the uncovered front portion of the cassette is totally accommodated within the housing and so that the front portion of the stack of sheets carried by the cassette lies below the in-feed rollers, a heating element mounted in the housing to extend above the front end of the cassette and parallel thereto for heating the front portion of the stack to keep the leading edges of the sheets dry and therefore free of waviness as the sheets are transported through the machine, means for supplying current to the heating elements, the in-feed rollers being mounted for vertical movement and biased downwardly against the top sheet on the stack, the in-feed rollers in addition being widely spaced from one another along the width dimension of the sheet, the heating element being at least partly contained in the space between the in-feed rollers to permit the vertical movement thereof.

10. The combination as claimed in claim 9 in which a cam and cam follower are interposed between the cassette and in-feed rollers so that upon insertion of the cassette into the housing engagement occurs between the cam and the cam follower for lifting the in-feed rollers so that they clear the front edge of the tray with subsequent lowering of the rollers into contact with the top sheet of the stack as the cassette completes its movement into its bottomed position.

11. In a photocopy machine the combination comprising a housing having a copy sheet entry way and a discharge slot, a copy sheet transport system including an intermittently driven in-feed roller, means acting upon a copy sheet to produce a developed image thereon during transport of the sheet from the entry way to the discharge slot, a copy sheet cassette including a shallow rectangular tray for a stack of copy sheets and having a front end and a rear end, the cassette including a fitted cover extending over the top of the tray but foreshortened to leave the front portion of the tray uncovered, the housing defining a receptacle at the entry way fitted to the front end of the cassette for plugging the cassette into the housing to a bottomed position in which the uncovered front portion of the cassette is totally accommodated within the housing and so that the front portion of the stack of sheets carried by the cassette lies below the in-feed roller for engagement thereby for feeding of sheets seriatim from the top of the stack, a first heating element in the cover of the cassette, the cover being of sandwich construction including (1) an insulative top plate, (2) an extensive central plate including the heating element and (3) a thermally conductive bottom plate so that when the plates are secured together in compact relation the heating element is in intimate thermal engagement with the bottom plate for heating the body portion of the stack, a second heating element in the housing extending transversely in a position above the front end of the cassette, the second heating element serving to heat the front portion of the stack to keep the leading edge of the sheets dry and free of waviness as the sheets are transported through the machine, and means for supplying current to the heating elements.

12. In a photocopy machine the combination comprising a housing having a copy sheet entry way and discharge slot, a copy sheet transport system including an intermittently driven in-feed roller, means acting upon a copy sheet to produce a developed image thereon during transport of the sheet from the entry way to the discharge slot, a copy sheet cassette including a shallow rectangular tray for a stack of copy sheets and having a front end and a rear end, the cassette including a fitted cover extending over the top of the tray but foreshortened to leave the front portion of the tray uncovered, the housing defining a receptacle at the entry way fitted to the front end of the cassette for plugging the cassette into the housing to a bottomed position in which the uncovered front portion of the cassette is totally accommodated within the housing and so that the front portion of the stack of sheets carried by the cassette lies below the in-feed roller for engagement thereby for feeding of sheets seriatim from the top of the stack, a first heating element mounted in the cassette for heating the body portion of the stack, a second heating element mounted in the housing at the front end of the cassette and parallel thereto for heating the front portion of the stack to keep the leading edges of the sheets dry and therefore free of waviness as the sheets are transported through the machine, and means for supplying current to the heating elements to maintain a substantially constant average temperature thereof even during periods of non-use of the machine.

13. The combination as claimed in claim 1 or in claim 4 or in claim 11 in which the heating elements are formed of conductive polymeric material in which the resistance is a positive function of the temperature so as to be self-regulating and in which the polymeric material is so chosen as to provide a regulated temperature within substantially the range of 150 degrees F. to 185 degrees F.

14. The combination as claimed in claim 2 or in claim 5 or in claim 9 in which the heating element is formed of conductive polymeric material in which the resistance is a positive function of the temperature so as to be self-regulating and in which the polymeric material is so chosen as to provide a regulated temperature within substantially the range of 150 degrees F. to 185 degrees F.

15. The combination as claimed in claim 1 or in claim 4 or in claim 11 in which the means for supplying current to the heating elements is activated constantly so that the sheets stored in the cassette are constantly dry and free of waviness even after long periods of non-use of the machine.

* * * * *